US011547184B2

(12) United States Patent
Bunch

(10) Patent No.: US 11,547,184 B2
(45) Date of Patent: Jan. 10, 2023

(54) WEARABLE ACTIVITY DEVICE

(71) Applicant: Michael Dennis Bunch, Mount Lebanon, PA (US)

(72) Inventor: Michael Dennis Bunch, Mount Lebanon, PA (US)

( * ) Notice: Subject to any disclaimer, the term of this patent is extended or adjusted under 35 U.S.C. 154(b) by 192 days.

(21) Appl. No.: 17/174,745

(22) Filed: Feb. 12, 2021

(65) Prior Publication Data

US 2021/0298430 A1 Sep. 30, 2021

Related U.S. Application Data

(60) Provisional application No. 62/993,758, filed on Mar. 24, 2020.

(51) Int. Cl.
*A44C 5/00* (2006.01)

(52) U.S. Cl.
CPC ..... *A44C 5/0015* (2013.01); *A44C 5/003* (2013.01)

(58) Field of Classification Search
CPC ..... A44C 5/0007; A44C 5/003; A44C 5/0023; A44C 5/0084; A44C 5/0092; A44C 5/12; A44C 9/0053; A44C 9/0084
See application file for complete search history.

(56) References Cited

U.S. PATENT DOCUMENTS 1,628,278 A * 5/1927 Scheuer ..... A44C 15/0075 63/3.1
3,124,286 A * 3/1964 Dompier ..... A44B 15/00 224/220
4,842,212 A * 6/1989 Loiselle ..... B65H 75/406 242/405
5,820,577 A 10/1998 Taylor
6,293,919 B1 9/2001 Manente
6,422,975 B1 7/2002 Chermak
7,922,049 B2 * 4/2011 Wu ..... A45F 5/00 224/267
2006/0042313 A1 * 3/2006 Mattiacci ..... A44C 9/0084 63/1.18

(Continued)

FOREIGN PATENT DOCUMENTS

FR 3070580 A1 * 3/2019 ..... A44C 5/0053
GB 2489736 A 10/2012

(Continued)

*Primary Examiner* — Jack W Lavinder
(74) *Attorney, Agent, or Firm* — PatentFile, LLC; Bradley C. Fach; Steven R. Kick

(57) ABSTRACT

A wearable activity device may include a body configured to be worn around a user's wrist. A cavity may be formed within the body, and one or more cavity apertures may be disposed within the body with each cavity aperture providing access to a cavity. One or more bands may be coupled to the body, and each band may comprise an external portion and an internal portion. The external portions may be positioned exterior to the body and may extend between two cavity apertures and the internal portions may be positioned within a cavity. The size of each external portion may be expandable to allow it to be positioned around a user's finger while the body is worn on the wrist, and the size of the external portion of each band may be decreased in size to preferably rest against the body when it is not positioned around a finger.

18 Claims, 7 Drawing Sheets

(56) References Cited

U.S. PATENT DOCUMENTS

| | | | | |
|---|---|---|---|---|
| 2006/0144083 | A1* | 7/2006 | Layton | A44C 5/0007 63/3.1 |
| 2018/0214342 | A1 | 8/2018 | Harrison | |
| 2018/0303651 | A1 | 10/2018 | Myers | |
| 2019/0380857 | A1 | 12/2019 | Gelanyi | |

FOREIGN PATENT DOCUMENTS

| | | | |
|---|---|---|---|
| KR | 200420416 | Y1 * | 7/2006 |
| WO | 2014138935 | A1 | 9/2014 |

* cited by examiner

WEARABLE ACTIVITY DEVICE

CROSS REFERENCE TO RELATED APPLICATIONS

This application claims priority to and the benefit of the filing date of U.S. Provisional Application No. 62/993,758, filed on Mar. 24, 2020, entitled "WEARABLE ACTIVITY DEVICE", which is hereby incorporated by reference in its entirety.

FIELD OF THE INVENTION

This patent specification relates to the field of wearable activity devices. More specifically, this patent specification relates to a wearable device having one or more bands which may be removably positioned around portions of a user's body which may be used to provide a tactile and visual reminder or facilitator for one or more activities.

BACKGROUND

Most people lead busy lives having many activities that they need and wish to accomplish. However, it can be increasingly difficult to remember and perform these activities. Additionally, many people suffer from attention deficit hyperactivity disorder (ADHD), post-traumatic stress disorder (PTSD), dementia, Alzheimer's disease, and other memory and cognitive diseases and disorders. While memory and remembering devices, such as setting alarms and reminders in a smartphone, they tend to be time consuming to set up and can be disruptive to other individuals. Furthermore, these devices must be protected from liquids and shock so as to be difficult to use in an active setting.

Therefore, a need exists for novel devices which may be used to provide a reminder for one or more activities. A further need exists for novel reminder providing devices which are not audibly or visually intrusive to other individuals. There is also a need for novel reminder providing devices which are not time consuming to set up but which are quickly and easily manipulated. Still a further need exists for novel reminder providing devices which are durable and which can be used in watersports, physically demanding and contact sports, and other active settings.

BRIEF SUMMARY OF THE INVENTION

A wearable activity device which may be removably positioned around portions of a user's body which may be used to provide a tactile and visual reminder or facilitator for one or more activities is provided. Generally, the device may include one or more bands which may be removably and selectively positioned around the fingers of a user. The removable positioning of the bands of the device around a user's fingers may be used to help users: having problems with memory and/or paying attention; desiring to elevate their normal or usual performance; increase their ability to recall and remember; as a real time solution for forgetting; in assisting the cognitive processes of thinking, learning, and memory, and with any task that requires recall or memory. It should be understood that the device is not limited to the above-mentioned usage examples, but they are provided merely to show the wide-ranging utility of the device.

In some embodiments, a wearable activity device may include a preferably annular shaped body which may be configured to be worn around portions of the body of a user, such as their wrist. One or more cavities may be formed within the body, and one or more cavity apertures may be disposed within the body with each cavity aperture providing access to at least one cavity. One or more bands may be coupled to the body, and each band may comprise an external portion and an internal portion. The external portions may be positioned exterior to the body and may extend between two cavity apertures and the internal portions may be positioned within at least one cavity. The size of each external portion may be expandable so that it is able to be positioned around one or more fingers of a user while the body is worn on the user's wrist, and the size of the external portion of each band may be decreased in size to preferably rest against the body when it is not positioned around a finger.

In further embodiments, each band may be coupled within a cavity with an external portion of each band positioned outside a cavity and extending between two cavity apertures so that a single band extends between two cavity apertures.

In further embodiments, each band may be coupled within a cavity with an external portion of each band positioned outside a cavity and extending between two cavity apertures so that two or more bands extend between two cavity apertures.

In further embodiments, one or more bands may be configured with a different color and/or texture than one or more other bands.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
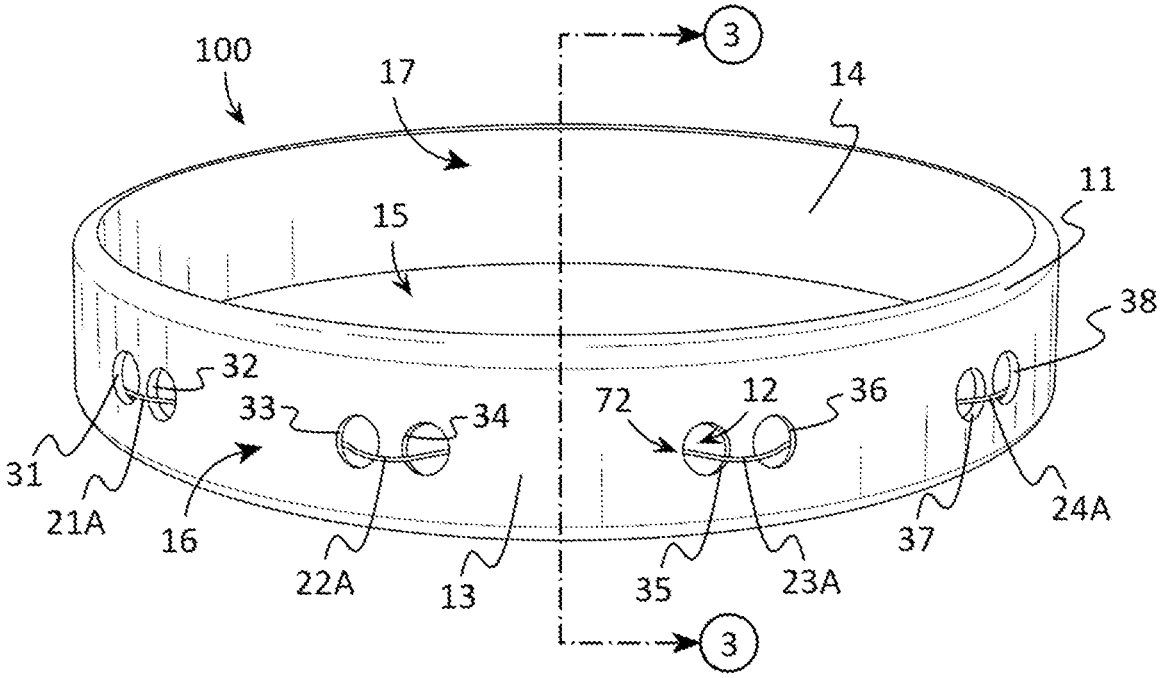
FIG. 1 depicts a perspective view of an example of a wearable activity device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new wearable activity device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-8 illustrate examples of a wearable activity device ("the device") 100 according to various embodiments. In some embodiments, the device 100 may comprise a preferably annular shaped body 11 which may be configured to be worn around portions of the body of a user 200, such as their wrist 201. One or more cavities 12, 12A, 12B, may be formed within the body 11, and one or more cavity apertures 31, 32, 33, 34, 35, 36, 37, 38, may be disposed within the body 11 with each cavity aperture 31, 32, 33, 34, 35, 36, 37, 38, providing access to at least one cavity 12, 12A, 12B. One or more bands 21, 22, 23, 24, may be coupled to the body 11, and each band 21, 22, 23, 24, may comprise an external portion 21A, 22A, 23A, 24A, and an internal portion 21B, 22B, 23B, 24B. The external portions 21A, 22A, 23A, 24A, may be positioned exterior to the body 11 and may extend between two cavity apertures 31, 32, 33, 34, 35, 36, 37, 38, and the internal portions 21B, 22B, 23B, 24B, may be positioned within at least one cavity. The size of each external portion 21A, 22A, 23A, 24A, may be expandable so that it is able to be positioned around one or more fingers 202, 203, 204, 205, of a user 200 while the body 11 is worn on the user's wrist 201, and the size of the external portion 21A, 22A, 23A, 24A, of each band 21, 22, 23, 24, may be decreased in size to rest against the body 11 when it is not positioned around a finger 202, 203, 204, 205.

The device 100 may comprise a body 11 which may be configured to be worn around portions of the body of a user 200. The body 11 may comprise or form a body aperture 15, optionally adjustable in size, through which a user 200 may insert portions of their body, such as their wrist 201. A body 11 may comprise an exterior wall 13 and an interior wall 14 which may be coupled together, such as by being integrally formed or molded together, heat bonding, adhesive bonding, etc. Generally, an exterior wall 13 may comprise or form a body exterior surface 16, and an interior wall 14 may comprise or form a body interior surface 17. One or more cavity apertures 31, 32, 33, 34, 35, 36, 37, 38, may be disposed in the body exterior surface 16, while a body interior surface 17 may form a body aperture 15 and may surround and contact portions of the body of a user 200.

In preferred embodiments, the body 11 may comprise a generally flexible or rigid annular or ring shape which may be sized to fit around portions of the wrist 201 of a user 200 similar to a bracelet. In some embodiments, a body 11 may be unitary in shape, while in other embodiments, a body 11 may have two or more ends which may be removably coupled together, similar to a watch strap or other removable or resizable bracelet coupling method.

A body 11 may be made from or may comprise any material suitable for contacting and being worn on the body of an individual. In some embodiments, all or portions of a body 11 may be made from or may comprise substantially rigid materials, such as steel alloys, aluminum, aluminum alloys, copper alloys, other types of metal or metal alloys, ceramics such as alumina, porcelain, and boron carbide, earthenware, natural stone, synthetic stone, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials that are substantially rigid.

In preferred embodiments, all or portions of a body 11 may be made from or may comprise a flexible material such as natural and/or synthetic rubber material such as latex rubber, silicone foam, silicone rubber, rubber foam, urethane foam, plastic foam, neoprene foam, latex foam rubber, polyurethane foam rubber, forms of the organic compound isoprene, Polyacrylate Rubber, Ethylene-acrylate Rubber, Polyester Urethane, flexible plastics, such as high-density polyethylene (HDPE), polyvinyl chloride (PVC), polypropylene (PP), Polystyrene (PS), Polycarbonate (PC), low density polyethylene (LDPE), or any other flexible material including combinations of materials.

In further embodiments, all or portions of a body 11 may be made from or may comprise various types synthetic fabrics such as polyester, acrylic, nylon, rayon, acetate, spandex, spandex blends, and Kevlar, and natural fabrics such as coir, cotton, hemp, jute, canvas, flax, leather, linen, ramie, wool, silk, or any other suitable flexible natural or synthetic material including combinations of materials.

The device 100 may comprise one or more cavities 12, 12A, 12B, 12C, such as a first cavity 12A, second cavity 12B, etc., which may be disposed or formed within the body 11. Generally, a cavity 12, 12A, 12B, 12C, may comprise a recess or cavity in the body 11 which may be sized and shaped to allow the internal portion 21B, 22B, 23B, 24B, of one or more bands 21, 22, 23, 24, to be positioned within the cavity 12, 12A, 12B, 12C. In preferred embodiments, a cavity 12, 12A, 12B, 12C, may comprise a recess or cavity in the body 11 which may be sized and shaped to allow between 25 and 99 percent of one or more bands 21, 22, 23, 24, to be positioned within the cavity 12, 12A, 12B, 12C, (as internal portions 21B, 22B, 23B, 24B) so that the remaining portion of the bands 21, 22, 23, 24, may be positioned outside the cavity 12, 12A, 12B, 12C, (as external portions 21A, 22A, 23A, 24A) so as to be graspable by a user 200.

A cavity 12, 12A, 12B, 12C, may comprise any shape and size. For example, and as perhaps best shown in FIG. 3, the device 100 may comprise a single relatively larger sized cavity 12, 12A which may be sized and shaped to allow all or portions of each band 21, 22, 23, 24, of the device 100 to be positioned within the cavity 12, 12A. In this manner, the internal portions 21B, 22B, 23B, 24B, of two or more bands 21, 22, 23, 24, may be positioned within the same cavity 12, 12A. As another example and as perhaps best shown in FIG. 5, the device 100 may comprise two or more relatively smaller sized cavities 12A, 12B, which may be sized and shaped to allow all or portions of at least one band 21, 22, 23, 24, of the device 100 to be positioned within a respective cavity 12A, 12B. In this manner, the internal portions 21B, 22B, 23B, 24B, of two or more bands 21, 22, 23, 24, may be positioned within the same cavity 12A (in the example of FIG. 5, a first internal portion 21B is positioned within a first cavity 12A and a second internal portion 22B is positioned within a second cavity 12B).

Figure 6:
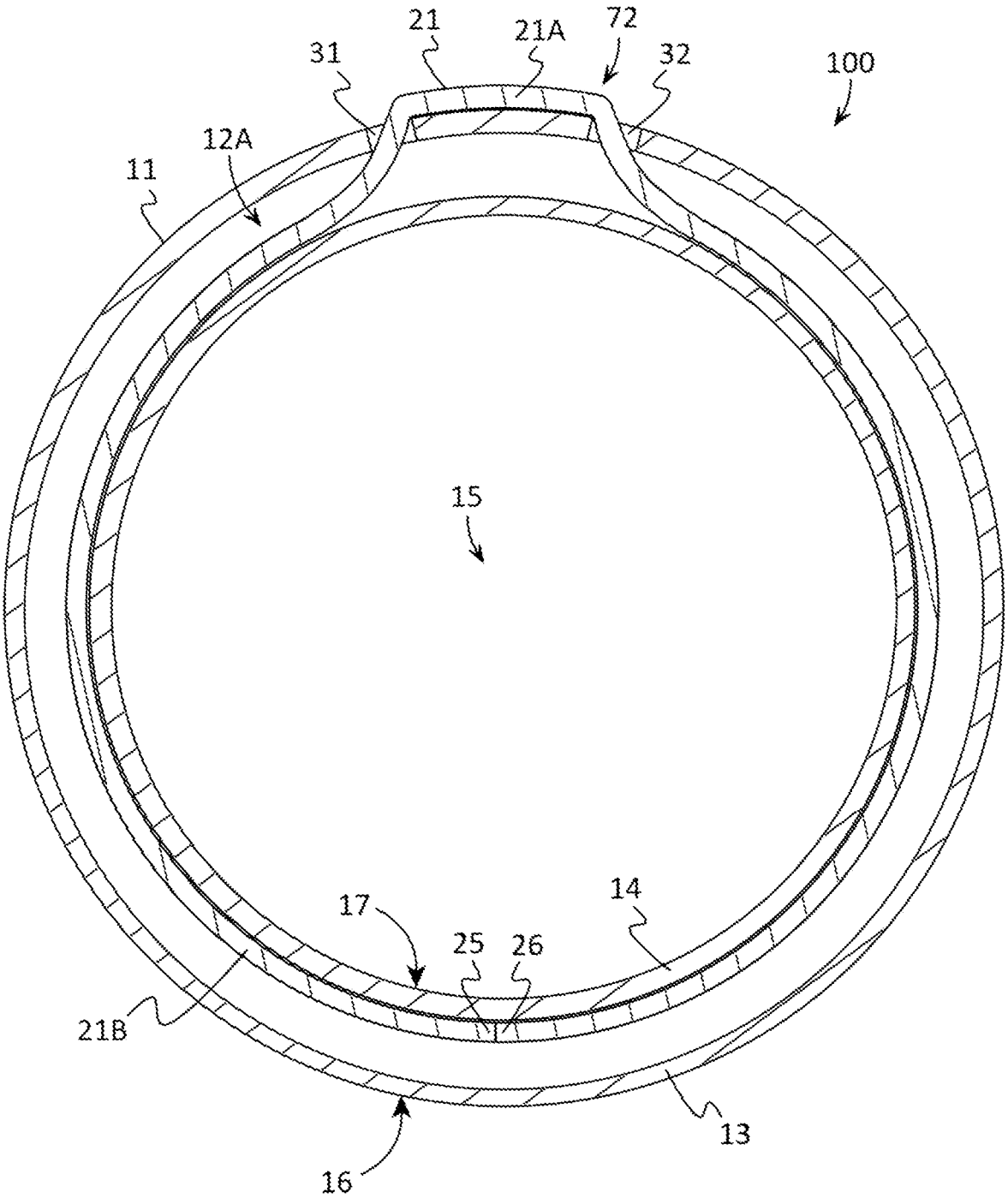
FIG. 6 shows a sectional, front elevation view of a further example of a wearable activity device according to various embodiments described herein.

In some embodiments, and as shown in FIG. 6, a cavity 12A, may be annular in shape to be continuous through a body 11 having an annular shape. Preferably, an annular shaped band 21, 22, 23, 24, may be coupled to the body 11 by having the band 21, 22, 23, 24, positioned in the cavity 12A, so that the band 21, 22, 23, 24, may encircle and annular shaped interior wall 14 thereby preventing the band 21, 22, 23, 24, from being completely removed from the cavity 12A.

Figure 7:
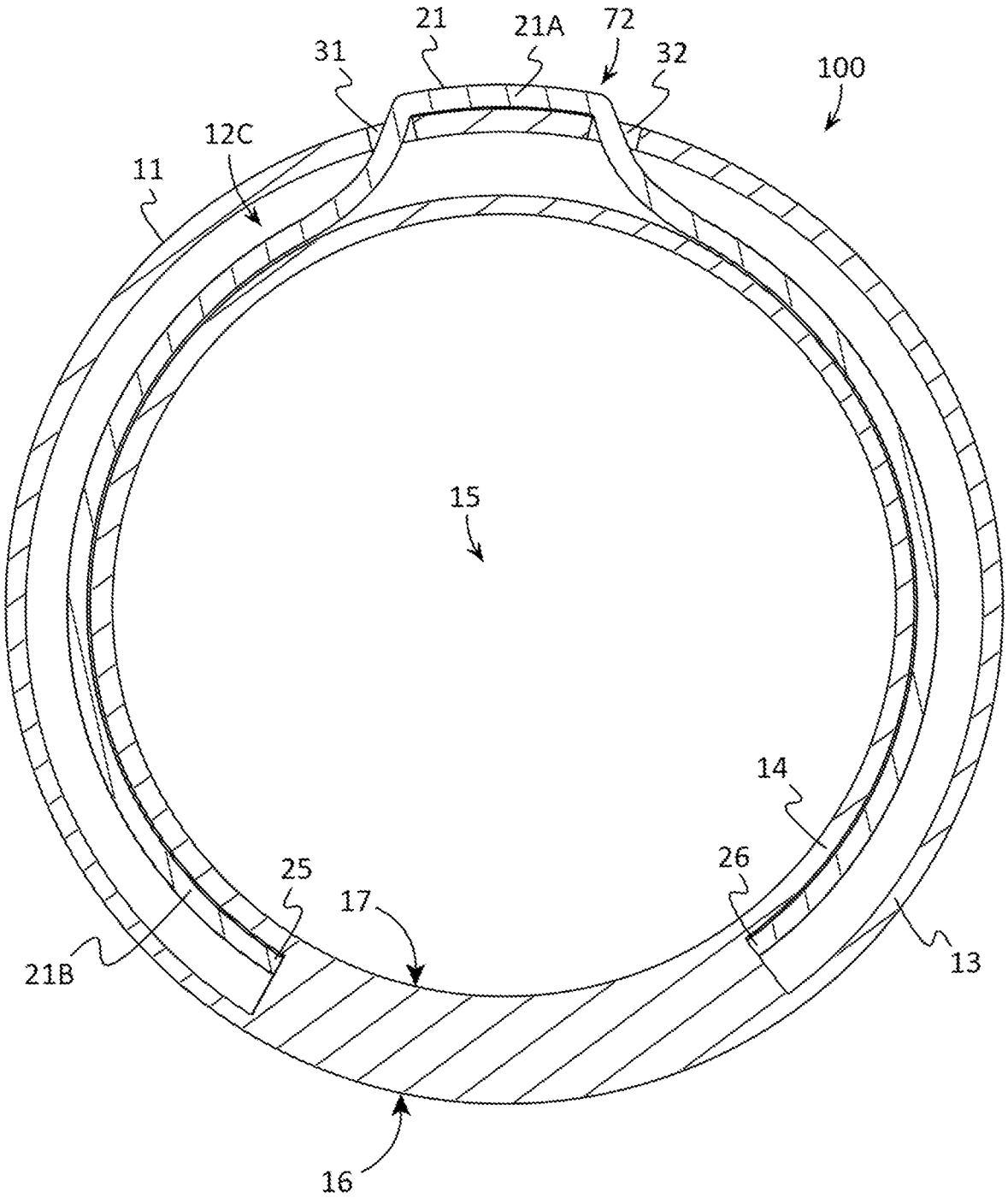
FIG. 7 depicts a sectional, front elevation view of yet a further example of a wearable activity device according to various embodiments described herein.
Figure 8:
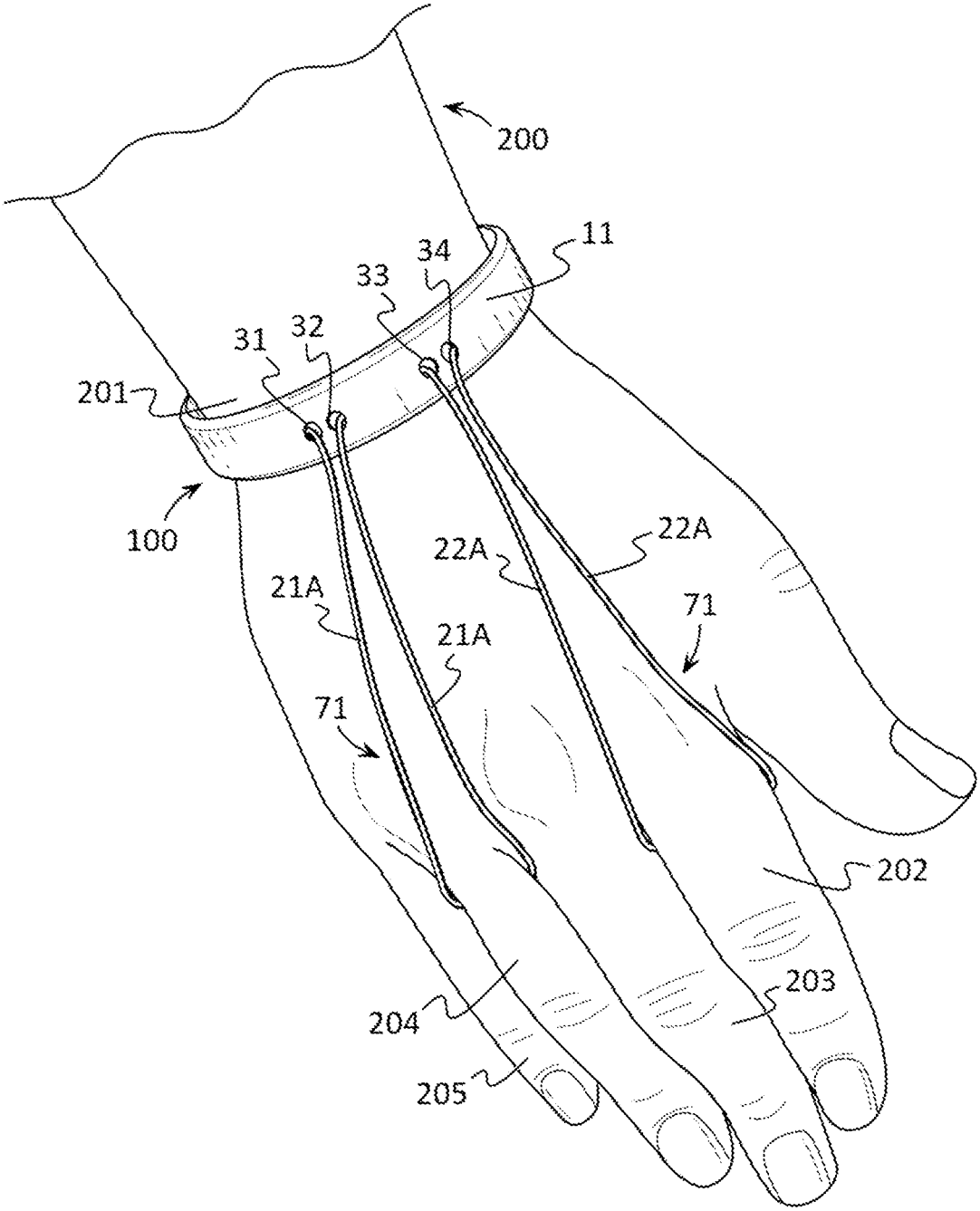
FIG. 8 illustrates a perspective view of a user wearing an example of a wearable activity device according to various embodiments described herein.

In some embodiments, and as shown in FIG. 7, a cavity 12C, may not be continuous through the annular shape of the body 11. Optionally, a band 21, 22, 23, 24, having a first end 25 and a second end 26, may be coupled to the body 11 by having the first end 25 and second end 26 positioned in the cavity 12C, and each end 25, 26, may be coupled to the body 11 thereby preventing the band 21, 22, 23, 24, from being completely removed from the cavity 12C.

The device 100 may comprise one or more cavity apertures 31, 32, 33, 34, 35, 36, 37, 38, which may be disposed or formed in the body 11. Preferably, each cavity aperture 31, 32, 33, 34, 35, 36, 37, 38, may be formed in an exterior wall 13 and may extend through the exterior wall 13 to be in communication with a cavity 12, 12A, 12B, 12C. Generally, the cavity apertures 31, 32, 33, 34, 35, 36, 37, 38, may provide an opening to a cavity 12, 12A, 12B, 12C, through which portions of one or more bands 21, 22, 23, 24, may be moved into and out of the cavity 12, 12A, 12B, 12C. Cavity apertures 31, 32, 33, 34, 35, 36, 37, 38, may be configured in any size and shape. For example, a cavity aperture 31, 32, 33, 34, 35, 36, 37, 38, may comprise a circular or oval shape, a rectangular shape, triangular shape, etc.

The device 100 may comprise one, two, three, four, five, six, seven, eight, or more bands 21, 22, 23, 24. For example, the device 100 may comprise a first band 21, a second band 22, a third band 23, and a fourth band 24, etc. In some embodiments, the device 100 may comprise a band 21, 22, 23, 24, that may be fed through four or more cavity apertures 31, 32, 33, 34, 35, 36, 37, 38. In some embodiments, a single band 21, 22, 23, 24, may be extended from two or more sets or pairs of cavity apertures 31, 32, 33, 34, 35, 36, 37, 38, so that the single band 21, 22, 23, 24, may comprise two or more external portions 21A, 22A, 23A, 24A. In further embodiments, two or more bands 21, 22, 23, 24, may be fed through the same two cavity apertures 31, 32, 33, 34, 35, 36, 37, 38, as perhaps best shown in FIG. 2. In still further embodiments, a single band 21, 22, 23, 24, may be extended from only one set or pair of cavity apertures 31, 32, 33, 34, 35, 36, 37, 38, so that each band 21, 22, 23, 24, may only be extended from a respective set or pair of cavity apertures 31, 32, 33, 34, 35, 36, 37, 38, as perhaps best shown in FIG. 1.

In preferred embodiments, each band 21, 22, 23, 24, may be moved between an extended position 71 and a retracted position 72. In further preferred embodiments, a portion of each band 21, 22, 23, 24, may be extended from and retracted into a cavity 12A, 12B, via one or more apertures 31, 32, 33, 34, 35, 36, 37, 38. In this manner, the size of the external portion 21A, 22A, 23A, 24A, of a band 21, 22, 23, 24, may be increased as the band 21, 22, 23, 24, is moved into the extended position 71. While in the retracted position 72 (best shown in FIGS. 1, 2, 4, 6, and 7) a relatively small amount of a band 21, 22, 23, 24, may be positioned outside a cavity 12A, 12B, (as an external portion 21A, 22A, 23A, 24A) and preferably tensioned against portions of a body exterior surface 16, between two or more apertures 31, 32, 33, 34, 35, 36, 37, 38. While in the extended position 71 (best shown in FIG. 8) a relatively large amount of a band 21, 22, 23, 24, may be positioned outside a cavity 12A, 12B, (as an external portion 21A, 22A, 23A, 24A) so as to be worn and positional around one or more of a user's fingers 202, 203, 204, 205, when the body 11 is being worn on the wrist 201 of the user 200.

In preferred embodiments, a band 21, 22, 23, 24, may be made from a resilient material, such as elastic fabric, flexible rubber, flexible plastic, etc. to allow an external portion 21A, 22A, 23A, 24A of the bands 21, 22, 23, 24, to be enlarged and positioned around portions of one or more fingers 202, 203, 204, 205, of a user 200 while the body 11 is positioned around the wrist 201 of the user 200. In preferred embodiments, a band 21, 22, 23, 24, may be made from a resilient material such as silicone foam, silicone rubber, rubber foam, urethane foam, plastic foam, neoprene foam, latex foam rubber, polyurethane foam rubber, or elastomer materials such as elastic plastic, elastic silicone, elastic rubber, or any other suitable elastomer or resilient material including combinations of materials so that the band 21, 22, 23, 24, may be stretched and then return to its original size after being stretched.

Preferably, each band 21, 22, 23, 24, may comprise a color and/or texture that may allow a user to easily distinguish one band 21, 22, 23, 24, from another. In some embodiments, one or more bands 21, 22, 23, 24, of the device 100 may be configured with a color that is different from one or more other bands 21, 22, 23, 24. In preferred embodiments, each band 21, 22, 23, 24, of the device 100 may be configured in a different color so that the bands 21, 22, 23, 24, each have a unique color. In further embodiments, a band 21, 22, 23, 24, may be configured in two or more colors. In still further embodiments, each band 21, 22, 23, 24, may comprise a different texture, such as smooth, bumpy, jagged, etc., to enable users 200, such as vision impaired users, to distinguish one band 21, 22, 23, 24, from another.

A band 21, 22, 23, 24, may be configured in any size and shape. In some embodiments, and as perhaps best shown in FIG. 7, a band 21 may comprise a first end 25 and an opposing second end 26 with each end 25, 26, coupled to the body 11 within a cavity 12A, 12B, and a portion of the band 21 between the two ends 25, 26, may extend through one or more cavity apertures 31, 32, so as to be graspable by a user 200. In further embodiments, and as perhaps best shown in FIG. 6, a band 21 may comprise an annular shape, e.g. a loop or circular shape, such as by having a first end 25 and an opposing second end 26 that are coupled to each other, with the majority of the band 21 position-able within a cavity 12A, 12B, as an internal portion 21A which the band 21 is not in the extended position 72, and a portion of the band 21 between the two ends may extend through one or more apertures 31, 32, so as to be graspable by a user 200 as an external portion 21B.

In some embodiments, a device 100 may comprise more than two cavity apertures 31, 32, 33, 34, 35, 36, 37, 38, and an external portion 21A, 22A, 23A, 24A, of a band 21, 22, 23, 24, may extend between two adjacent cavity apertures 31, 32, 33, 34, 35, 36, 37, 38. In further embodiments, a device 100 may comprise more than two cavity apertures 31, 32, 33, 34, 35, 36, 37, 38, and an external portion 21A, 22A, 23A, 24A, of a band 21, 22, 23, 24, may extend out of a cavity 12A, 12B, and between two non-adjacent apertures cavity apertures 31, 32, 33, 34, 35, 36, 37, 38. For example, a device 100 may comprise four cavity apertures 31, 32, 33, 34, 35, 36, 37, 38, that are linearly arranged on the body 11 and a band 21, 22, 23, 24, may extend out of a cavity 12A, 12B, and between a first aperture 31 and a third aperture 33.

Turning to the example of FIG. 1, in some embodiments, the device 100 may comprise four bands 21, 22, 23, 24, and eight cavity apertures 31, 32, 33, 34, 35, 36, 37, 38. A first band 21 may be coupled to the body 11, and the first band 21 may have a first external portion 21A and a first internal portion 21B. The first external portion 21A may be positioned exterior to the body 11 (outside the cavity 12A) and may extend between a first cavity aperture 31 and a second cavity aperture 32, and the first internal portion 21B may be positioned within the cavity 12A. A second band 22 may be coupled to the body 11, and the second band 22 may have a second external portion 22A and a second internal portion 22B. The second external portion 22A may be positioned exterior to the body 11 (outside the cavity 12A) and may extend between a third cavity aperture 33 and a fourth cavity aperture 34, and the second internal portion 22B may be positioned within the cavity 12A. A third band 23 may be coupled to the body 11, and the third band 23 may have a third external portion 23A and a third internal portion 23B. The third external portion 23A may be positioned exterior to the body 11 (outside the cavity 12A) and may extend between a fifth cavity aperture 35 and a sixth cavity aperture 36, and the third internal portion 23B may be positioned within the cavity 12A. A fourth band 24 may be coupled to the body 11, and the fourth band 24 may have a fourth external portion 24A and a fourth internal portion 24B. The fourth external portion 24A may be positioned exterior to the body 11 (outside the cavity 12A) and may extend between a seventh cavity aperture 37 and an eighth cavity aperture 38, and the fourth internal portion 24B may be positioned within the cavity 12A. The size of each external portion 21A, 22A, 23A, 24A, may be expandable so that it is able to be positioned around one or more fingers 202, 203, 204, 205, while the body 11 is worn on the wrist 201 of a user 200 (as shown by the exemplary bands 21, 22, in FIG. 8), and the size of each external portion 21A, 22A, 23A, 24A, may be decreased in size to rest against the body 11 when not positioned around a finger 202, 203, 204, 205, (as shown in FIG. 1).

Figure 2:
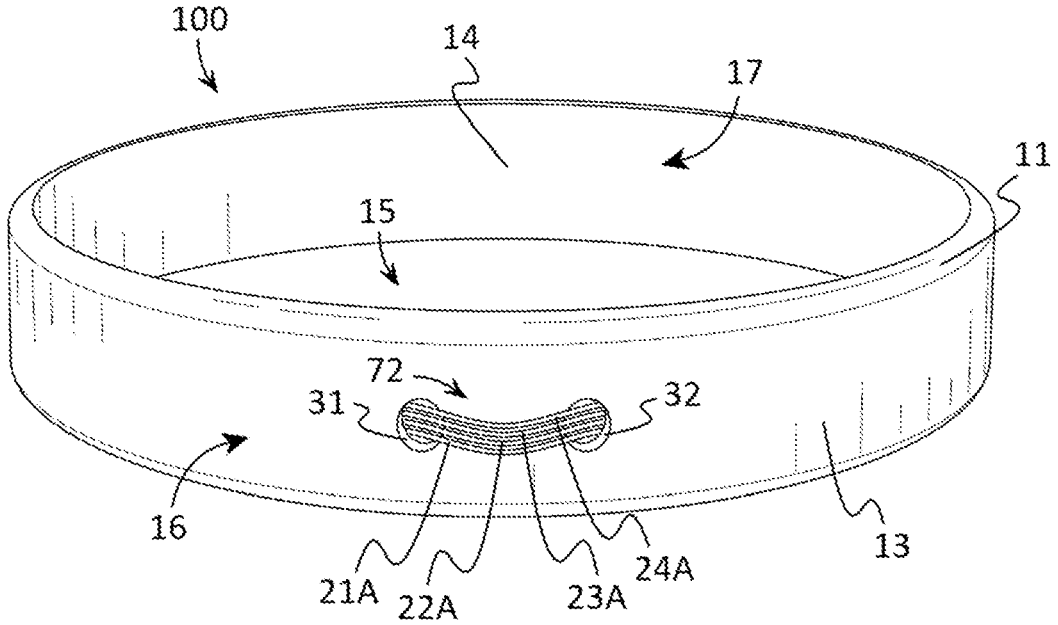
FIG. 2 illustrates a perspective view of another example of a wearable activity device according to various embodiments described herein.
Figure 3:
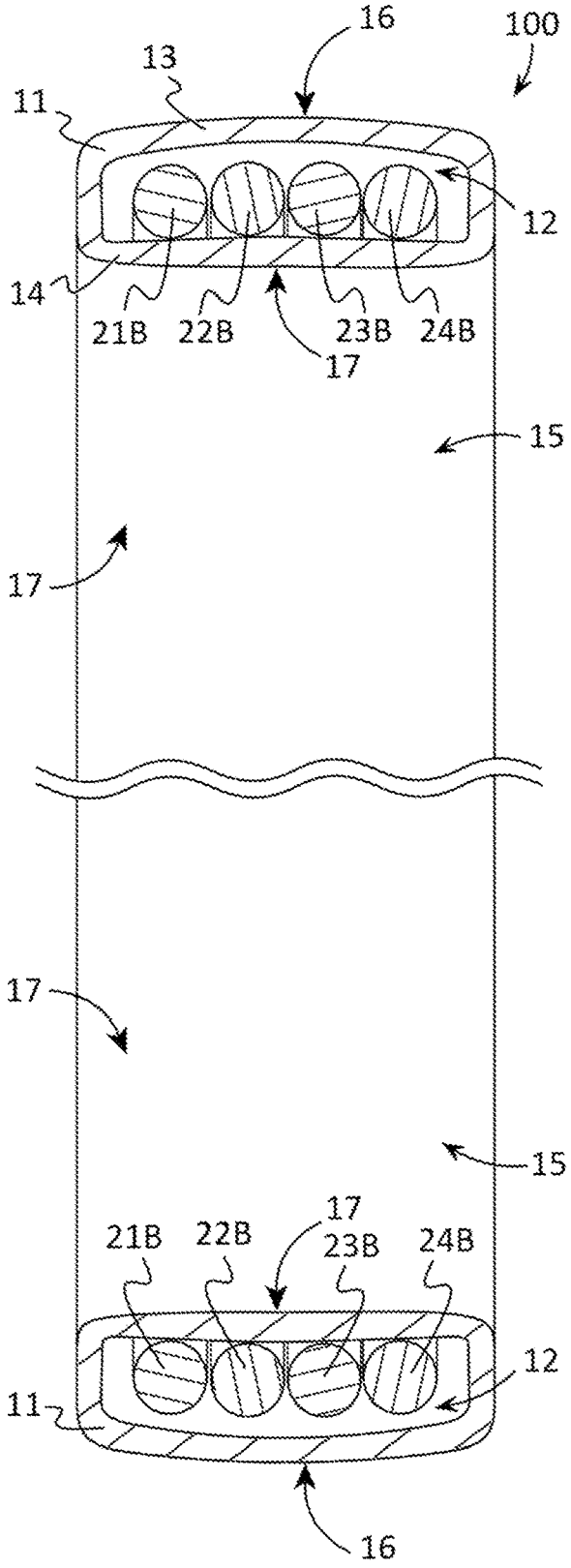
FIG. 3 shows a sectional, through line 3-3 shown in FIG. 1, side elevation view of an example of a wearable activity device according to various embodiments described herein.
Figure 4:
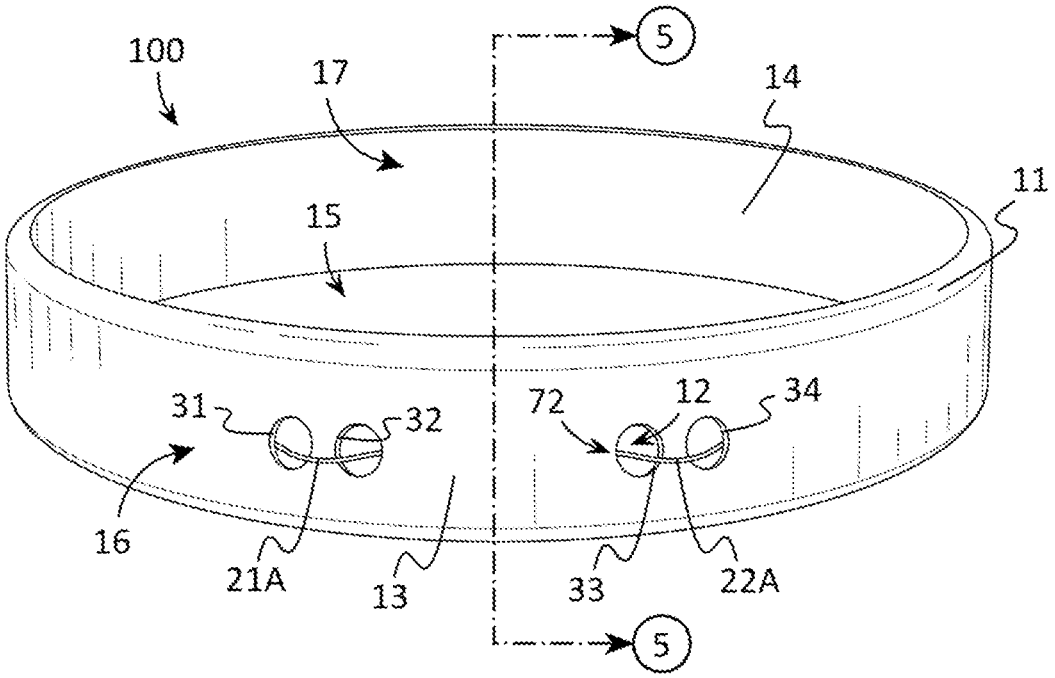
FIG. 4 depicts a perspective view of yet another example of a wearable activity device according to various embodiments described herein.
Figure 5:
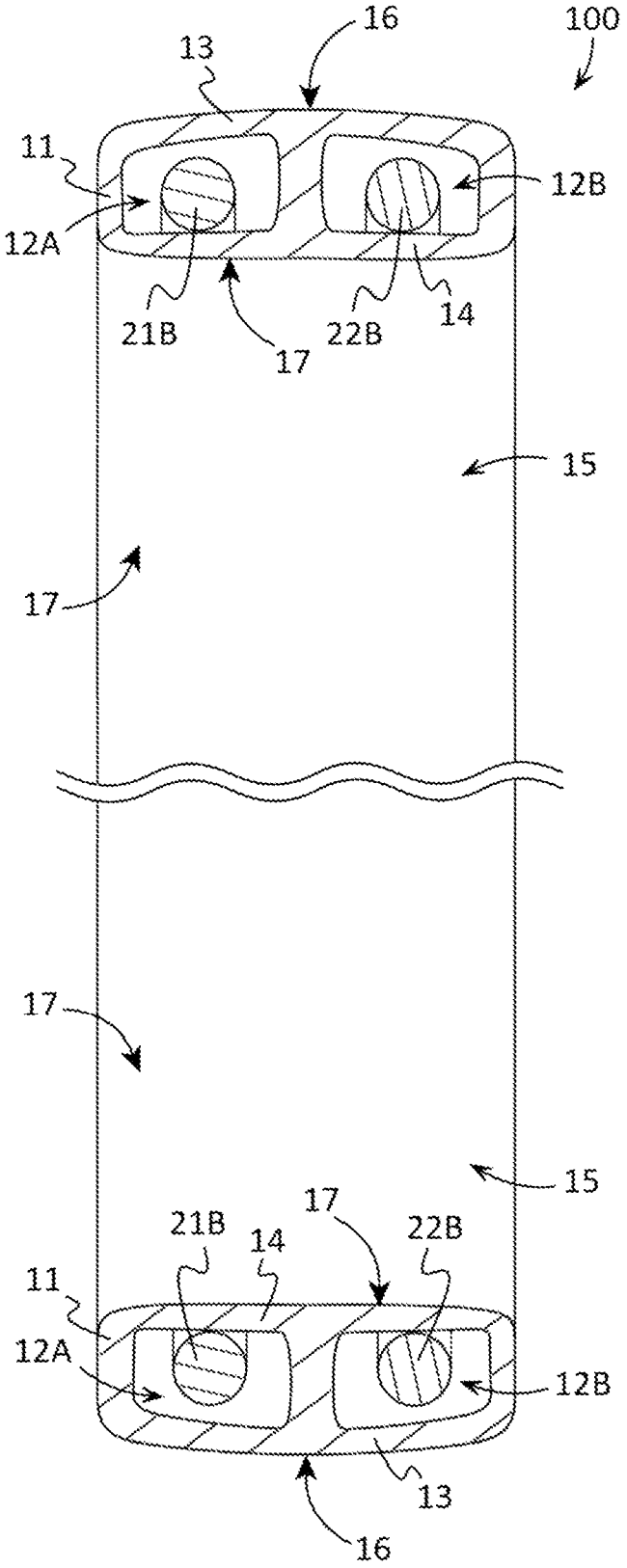
FIG. 5 illustrates a sectional, through line 5-5 shown in FIG. 4, side elevation view of an example of a wearable activity device according to various embodiments described herein.

Turning now to the example of FIG. 2, in some embodiments, the device 100 may comprise four bands 21, 22, 23, 24, and two cavity apertures 31, 32. Each band 21, 22, 23, 24, may be coupled to the body 11. An external portion 21A, 22A, 23A, 24A, of each band 21, 22, 23, 24, may be positioned outside the cavity 12A and may extend between the two cavity apertures 31, 32, while an internal portion 21B, 22B, 23B, 24B, of each band 21, 22, 23, 24, may be positioned inside the cavity 12A.

As best shown by FIG. 7, portions of each band 21, 22, 23, 24, may be extendable into and retractable from a cavity 12A, 12B, so that the amount of each band 21, 22, 23, 24, positioned outside the body 11 (the external portion 21A, 22A, 23A, 24A) may be manipulated by a user 200. In preferred embodiments, each band 21, 22, 23, 24, may be made of a resilient material so that the user 200 may stretch portions of each band 21, 22, 23, 24, to position and wear the external portion 21A, 22A, 23A, 24A of the bands 21, 22, 23, 24, on or over one or more desired fingers 202, 203, 204, 205, while the body 11 is worn on the wrist 201 of the user 200 as depicted in FIG. 7. When one or more bands 21, 22, 23, 24, are not positioned or being worn on or over one or more desired fingers 202, 203, 204, 205, the majority of those bands 21, 22, 23, 24, may be retracted and positioned within the cavity 12A, 12B, (as relatively larger internal portions 21B, 22B, 23B, 24B) so that preferably only a small portion of those bands 21, 22, 23, 24, are positioned outside the body 11 and its cavity(ies) 12A, 12B, (as relatively smaller external portions 21A, 22A, 23A, 24A). By having the majority of each band 21, 22, 23, 24, configured to retract into a cavity 12A, 12B, when not in use, the bands 21, 22, 23, 24, may be prevented from becoming caught or entangled on other objects.

The device 100 may be used to help a user 200 perform and/or remember one or more activities and things. For example, if a user 200 needs to perform and/or remember one or more activities/things, the user 200 may extend a desired band 21, 22, 23, 24, around a desired finger 202, 203, 204, 205, and/or thumb for each activity/thing. When the user 200 performs and/or remembers a thing/activity, the user 200 may remove the respective band 21, 22, 23, 24, from around their finger 202, 203, 204, 205, that they designated for the respective thing/activity. In this manner, the device 100 may be used to help users: having problems with memory and/or paying attention; desiring to elevate their normal or usual performance; increase their ability to recall and remember; as a real time solution for forgetting; in assisting the cognitive processes of thinking, learning, and memory, and with any task that requires recall or memory. It should be understood that the device 100 is not limited to the above-mentioned usage examples, but they are provided merely to show the wide ranging utility of the device 100.

While some exemplary shapes and sizes have been provided for elements of the device 100, it should be understood to one of ordinary skill in the art that the body 11, one or more cavities 12A, 12B, cavity apertures 31, 32, 33, 34, 35, 36, 37, 38, bands 21, 22, 23, 24, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A wearable activity device, the device comprising:
a body configured to be worn around a wrist of a user;
at least one cavity formed within the body;
a first cavity aperture disposed on the body, the first cavity aperture providing access to the at least one cavity;
a second cavity aperture disposed on the body, the second cavity aperture providing access to the at least one cavity;
a first band coupled to the body, the first band having a first external portion and a first internal portion, wherein the first external portion is positioned exterior to the body and extends between the first cavity aperture and the second cavity aperture, wherein the first internal portion is positioned within the at least one cavity, wherein the size of the first external portion is expandable so that it is able to be positioned around a first finger while the body is worn on a wrist, and wherein the size of the first external portion is decreased in size to rest against the body when not positioned around a first finger.

2. The device of claim 1, wherein the first band comprises a resilient material.

3. The device of claim 1, wherein the body is made from a flexible material.

4. The device of claim 1, wherein the at least one cavity is annular in shape to be continuous through the body.

5. The device of claim 1, wherein the first band is annular in shape.

6. The device of claim 1, further comprising a second band coupled to the body, the second band having a second external portion and a second internal portion, wherein the second external portion is positioned exterior to the body, wherein the second internal portion is positioned within the at least one cavity, wherein the size of the second external portion is expandable so that it is able to be positioned around a second finger while the body is worn on a wrist, and wherein the size of the second external portion is decreased in size to rest against the body when not positioned around a second finger.

7. The device of claim 6, wherein the second band is annular in shape.

8. The device of claim 7, wherein the second band extends between the first cavity aperture and the second cavity aperture.

9. The device of claim 7, further comprising a third cavity aperture and a fourth cavity aperture, wherein the second band extends between the third cavity aperture and the fourth cavity aperture.

10. The device of claim 7, wherein the at least one cavity comprises a first cavity and a second cavity, wherein the first internal portion is positioned within the first cavity, and wherein the second internal portion is positioned within the second cavity.

11. A wearable activity device, the device comprising:
an annular shaped body configured to be worn around a wrist of a user;
at least one cavity formed within the annular shaped body;
a first cavity aperture disposed on the annular shaped body, the first cavity aperture providing access to the at least one cavity;

a second cavity aperture disposed on the annular shaped body, the second cavity aperture providing access to the at least one cavity;

a first band coupled to the annular shaped body, the first band made from a resilient material, the first band having an annular shape, and the first band having a first external portion and a first internal portion, wherein the first external portion is positioned exterior to the annular shaped body and extends between the first cavity aperture and the second cavity aperture, wherein the first internal portion is positioned within the at least one cavity, wherein the size of the first external portion is expandable so that it is able to be positioned around a first finger while the annular shaped body is worn on a wrist, and wherein the size of the first external portion is decreased in size to rest against the annular shaped body when not positioned around a first finger.

12. The device of claim 11, wherein the annular shaped body is made from a flexible material.

13. The device of claim 11, wherein the at least one cavity is annular in shape to be continuous through the annular shaped body.

14. The device of claim 11, further comprising a second band coupled to the annular shaped body, the second band having a second external portion and a second internal portion, wherein the second external portion is positioned exterior to the annular shaped body, wherein the second internal portion is positioned within the at least one cavity, wherein the size of the second external portion is expandable so that it is able to be positioned around a second finger while the annular shaped body is worn on a wrist, and wherein the size of the second external portion is decreased in size to rest against the annular shaped body when not positioned around a second finger.

15. The device of claim 14, wherein the at least one cavity comprises a first cavity and a second cavity, wherein the first internal portion is positioned within the first cavity, and wherein the second internal portion is positioned within the second cavity.

16. The device of claim 14, wherein the second band is annular in shape.

17. The device of claim 14, wherein the second band extends between the first cavity aperture and the second cavity aperture.

18. The device of claim 14, further comprising a third cavity aperture and a fourth cavity aperture, wherein the second band extends between the third cavity aperture and the fourth cavity aperture.

* * * * *